US008617319B2

(12) United States Patent
Son

(10) Patent No.: US 8,617,319 B2
(45) Date of Patent: Dec. 31, 2013

(54) DISHWASHER AND METHOD OF CONTROLLING A DISHWASHER

(75) Inventor: Ro Mon Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1215 days.

(21) Appl. No.: 12/200,082

(22) Filed: Aug. 28, 2008

(65) Prior Publication Data

US 2009/0056756 A1 Mar. 5, 2009

(30) Foreign Application Priority Data

Aug. 31, 2007 (KR) ..... 10-2007-0088506

(51) Int. Cl.
*B08B 3/00* (2006.01)

(52) U.S. Cl.
USPC ..... 134/56 D; 134/18; 134/21; 134/105

(58) Field of Classification Search
USPC ..... 134/18, 21, 57 D, 105
See application file for complete search history.

(56) References Cited

U.S. PATENT DOCUMENTS 6,626,013 B2 * 9/2003 Ohta et al. ..... 68/12.27
2005/0284507 A1 * 12/2005 Boesche ..... 134/56 D

FOREIGN PATENT DOCUMENTS

EP 1096052 A2 * 5/2001 ..... D60F 39/10
JP 05-115414 5/1993

* cited by examiner

*Primary Examiner* — Michael Kornakov
*Assistant Examiner* — Katelyn Whatley
(74) *Attorney, Agent, or Firm* — KED & Associates, LLP

(57) ABSTRACT

A dishwasher is provided which can determine whether a filtering device needs to be cleaned based on the time taken for a drain pump to discharge wash fluid from a sump. The dishwasher can make this determination without a manual examination of food waste collected in the filtering device. A related method of controlling the dishwasher based on such a determination is also provided.

17 Claims, 7 Drawing Sheets

DISHWASHER AND METHOD OF CONTROLLING A DISHWASHER

This application claims priority to Korean Patent Application No. 10-2007-0088506 filed in Korea on Aug. 31, 2007, the entirety of which is incorporated herein by reference.

BACKGROUND

1. Field

This relates to a dishwasher and a method of controlling a dishwasher, and more particularly, to a dishwasher which can determine whether a filtering device needs to be cleaned and a related control method.

2. Background

Dishwashers use high-pressure wash water sprayed through nozzles to wash dishes. In general, dishwashers include a washing tub and a sump disposed at the bottom of the tub that contains wash fluid. Dishwashers may perform a washing operation, a drain operation, a rinsing operation and a drying operation.

Dishwashers may also include a filtering device disposed in the sump to filter residue from waste wash fluid produced during a washing operation.

However, conventional dishwashers require users to determine the amount of waste collected in such a filtering device in order to determine whether the filtering device needs to be cleaned, thus causing user inconvenience.

SUMMARY

A dishwasher is provided which can determine whether it is necessary to clean a filter device.

A dishwasher as embodied and broadly described herein may include a sump configured to contain wash water; a filtering device configured to filter food waste out of wash water contained in the sump; a drain pump configured to discharge the wash water contained in the sump through the filtering device; and a control unit configured to determine whether the filtering device needs to be cleaned based on the time taken for the drain pump to drain the sump.

The dishwasher may also include an alarm device configured to notify a user that the filtering device needs to be cleaned if the control unit determines that the filtering device needs to be cleaned.

The control unit may measure the time taken to drain the sump and may determine that the filtering device needs to be cleaned if the time taken to drain the sump exceeds a predefined reference level. The predefined reference level may be set based on the time taken to drain the sump when no food waste exists in the filtering device.

A method of controlling a dishwasher as embodied and broadly described herein may include driving the drain pump so as to discharge wash water contained in a sump to be discharged through a filtering device; measuring the time taken to drain the sump; and if the time taken to drain the sump exceeds a predefined reference level, issuing a request for cleaning the filtering device to a user.

In a dishwasher as embodied and broadly described herein, the dishwasher can determine whether the filtering device needs to be cleaned based on the time taken for the drain pump to discharge wash water without the need for a user to examine the amount of food waste collected in the filtering device.

In addition, it is possible to determine whether the filtering device needs to be cleaned without the use of an additional sensor for determining the amount of food waste collected in the filtering device.

BRIEF DESCRIPTION OF THE DRAWINGS

The embodiments will be described in detail with reference to the following drawings in which like reference numerals refer to like elements wherein:

FIG. 7 illustrates a flowchart of the operation of a controller shown in FIG. 4 when the dishwasher shown in FIG. 1 is turned on.

DETAILED DESCRIPTION

Exemplary embodiments will hereinafter be described in detail with reference to the accompanying drawings.

Figure 1:
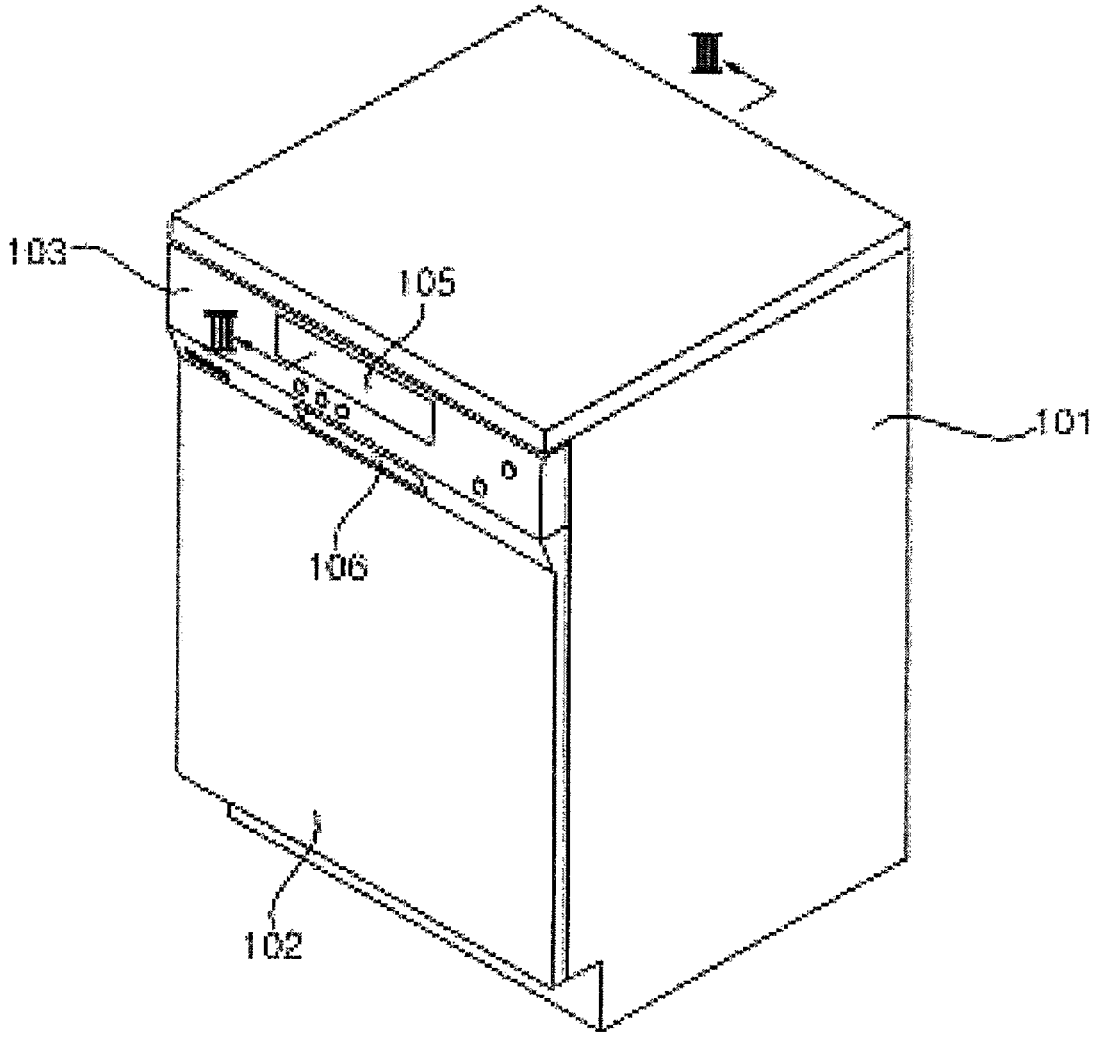
FIG. 1 illustrates a perspective view of a dishwasher according to an exemplary embodiment as broadly described herein.

The dishwasher 100 shown in FIG. 1 includes a main body case 101 which forms the exterior of the dishwasher 100, defines the space for washing dishes, and is open at the front, a door 102 which opens or closes the front of the main body case 101, and a control panel 103 disposed above the door 102 to manipulate the functions of the dishwasher 100 and display information regarding the operating state of the dishwasher 100. The dishwasher 100 also includes a door handle 106 disposed below the control panel 103 to open or close the door 102.

Figure 2:
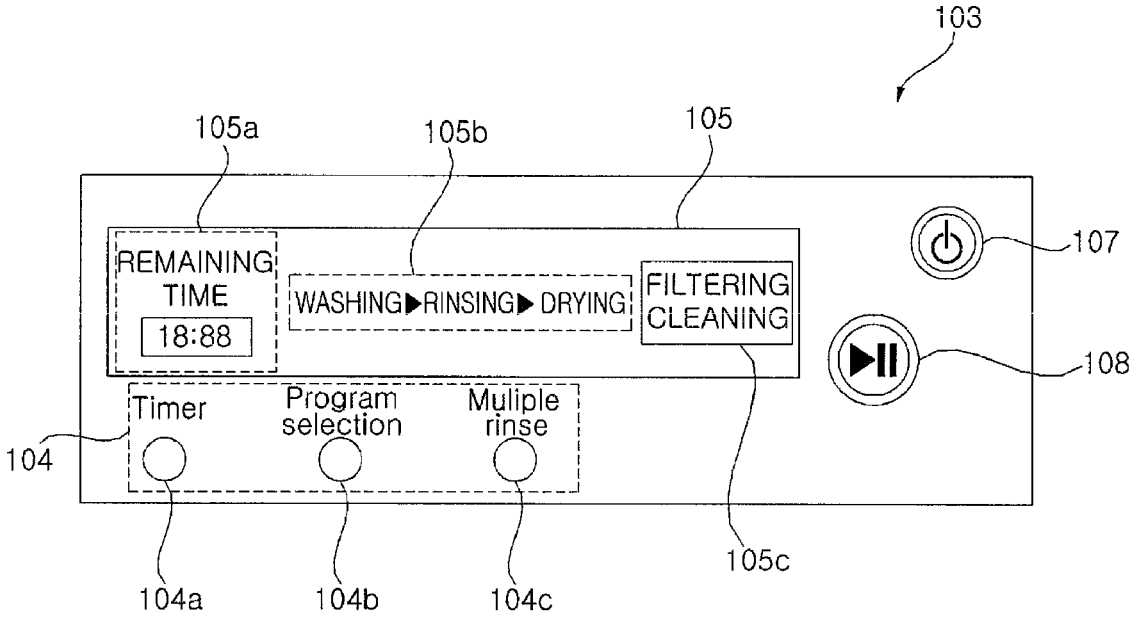
FIG. 2 illustrates a front view of a control panel of the dishwasher shown in FIG. 1.

Referring to FIGS. 1 and 2, the control panel 103 includes a power button 107 for turning the dishwasher 100 on/off, a start/pause button 108 for driving the dishwasher 100 or temporarily stopping the operation of the dishwasher 100, a function manipulation device 104 allowing a user to choose, for example, a dishwashing program, and a display 105 for displaying the operating state of the dishwasher 100.

The function manipulation device 104 includes a program selection button **104*b* for choosing one of a plurality of dishwashing programs (such as normal, intensive, and economic), a timer button 104*a* for setting up a washing schedule, and a multiple-rinse button 104*c* for performing multiple rinse operations. The function manipulation device 104** may also include various buttons for choosing various options, other than those set forth herein.

The display 105 includes a first region **105*a* in which the remaining operating time of the dishwasher 100 is displayed, a second region 105*b* in which a dishwashing program chosen by the user and the operating state of the dishwasher 100 is displayed, and a third region 105*c*** that provides an indication of whether or not a filtering device needs to be cleaned.

Figure 3:
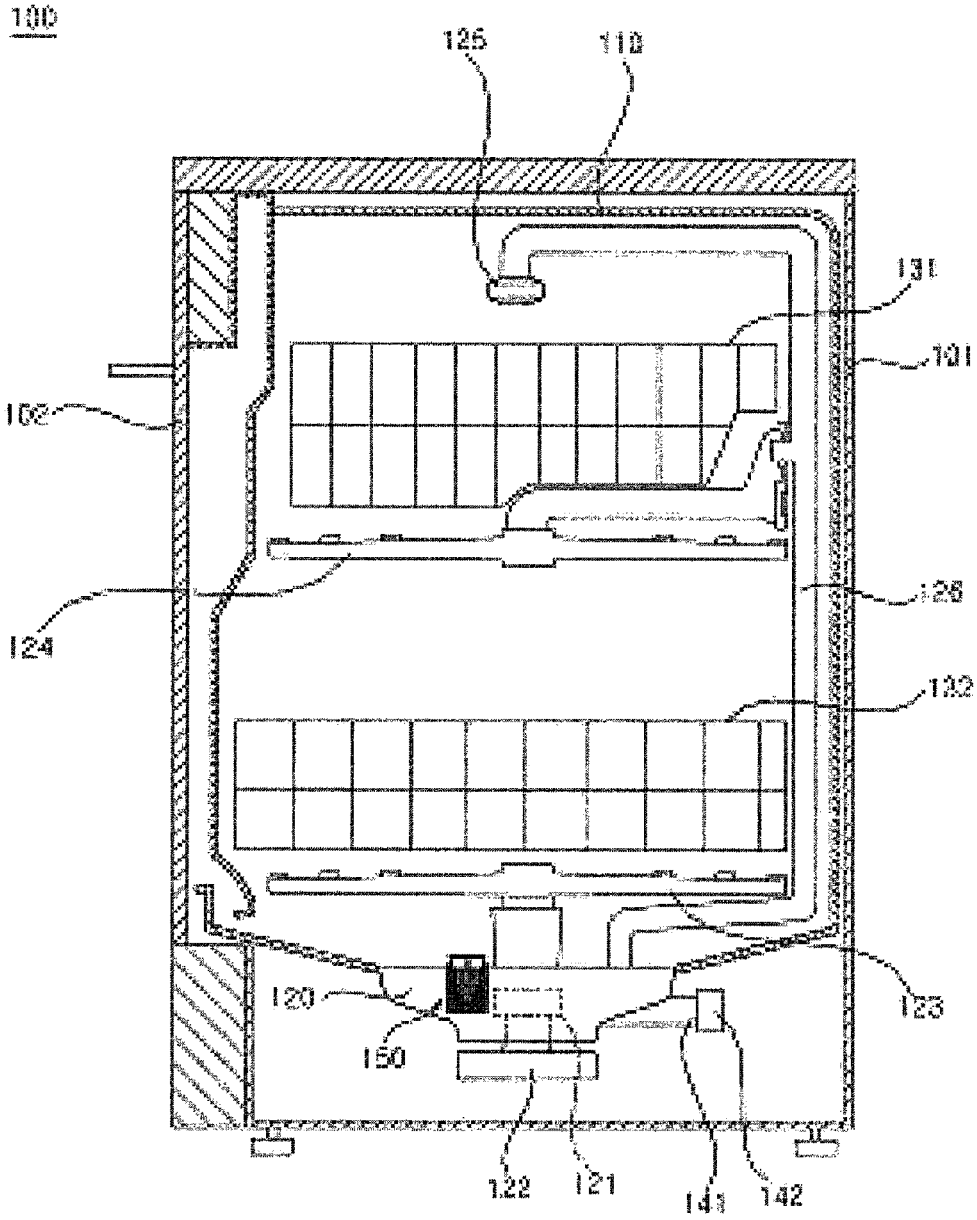
FIG. 3 illustrates a cross-sectional view taken along line III-III' of FIG. 1.

Referring to FIG. 3, the dishwasher 100 may also include a tub 110 which serves as a washing tub for washing dishes, a sump 120 disposed at the center of the bottom of the tub 110 to contain wash fluid, upper and lower racks 131 and 132 movably disposed in the tub 110 to hold dishes, a washing pump 121 which pumps wash fluid out of the sump 120 at high pressure, a washing motor 122 disposed on one side of the washing pump 121 to drive the washing pump 121, a guide 126 which guides the wash fluid pumped by the washing pump 121, a lower nozzle 123 disposed above the sump 120 to spray wash fluid up toward the lower rack 132, an upper nozzle 124 connected to the guide 126 and disposed below the upper rack 131 to spray wash fluid up toward the upper rack 131, a top nozzle 125 disposed near the ceiling of the tub 110 to spray wash fluid down toward the upper rack 131, a drain pump 141 disposed on one side of the sump 120 to drain wash fluid out of the sump 120, and a drain motor 142 which drives the drain pump 141.

The dishwasher 100 may also include a filtering device 150. Waste wash fluid generated during a washing operation is collected in the sump 120 and is then discharged from the dishwasher 100. The waste wash fluid collected in the sump 120 may be injected back into the tub 110 through the upper nozzle 124 and/or the lower nozzle 123 by being pumped by the washing pump 121, and may then be used again to wash dishes. Thereafter, the reused wash fluid may be discharged from the dishwasher 100 through the drain pump 141. Residue may be removed from the dishes by high-pressure wash fluid sprayed into the tub 110 and may then be collected at the bottom of the tub 110. Since waste wash fluid is collected in the sump 120 through the filtering device 150, the residue may be filtered out by the filtering device 150.

If too much food waste is accumulated in the filtering device 150, the amount of wash fluid collected in the sump 120 may decrease. In this case, the pumping pressure of the washing pump 121 may decrease, and the time taken to drain wash fluid from the dishwasher 100 may increase. Thus, the performance of the dishwasher 100 may deteriorate. In addition, if the filtering device 150 is not cleaned for a long time especially during the summer, the dishwasher 100 may emit an offensive odor due to food waste collected in the filtering device 150. Therefore, if the amount of food waste collected in the filtering device 150 reaches a predefined reference level, the user may need to clean the filtering device 150. That is, the user may need to periodically clean the filtering device 150 by separating the filtering device 150 from the sump 120, removing food waste from the filtering device 150, and washing the filtering device 150 with running water.

Figure 4:
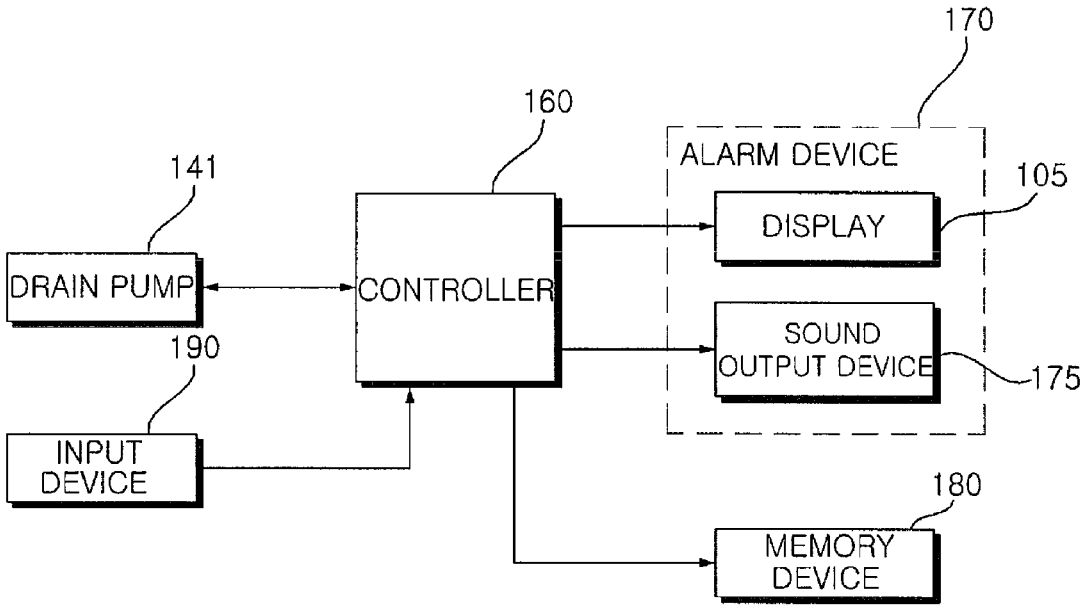
FIG. 4 illustrates a block diagram of the dishwasher shown in FIG. 1.

FIG. 4 illustrates a block diagram of the dishwasher 100 shown in FIG. 1. Referring to FIG. 4, the dishwasher 100 may also include a controller 160 which determines whether the filtering device 150 needs to be cleaned, and an alarm device 170 which provides the results of the determination performed by the controller 160 and thus allows the user to recognize whether the filtering device 150 needs to be cleaned. The controller 160 may also control the operation of the dishwasher 100.

The controller 160 may determine when to clean the filtering device 150, and particularly, whether the filtering device 150 needs to be cleaned, based on the time taken for the drain pump 141 to discharge wash fluid through the filtering device 150. More specifically, the controller 160 measures the time taken to perform a drain operation, which is the final phase of a washing operation. Thereafter, if the time taken to perform a drain operation exceeds the predefined reference level, the controller 160 may notify the user that the filtering device 150 needs to be cleaned through the alarm device 170.

The predefined reference level may be set based on the time taken to perform a drain operation when no food waste exists in the filtering device 150. More specifically, the predefined reference level may be determined experimentally by measuring the time taken to perform a drain operation when no food waste exists in the filtering device 150 and adding a predetermined value $\Delta T$ to the result of the measurement. The predetermined value $\Delta T$ may be determined based on the type and the capacity of the filtering device 150. For example, the predetermined reference level may be set to one minute. However, the embodiments as broadly described herein are not restricted to this. That is, the predefined reference level may be altered according to the capacity and the structure of the sump 120 and the type of the filtering device 150.

The alarm device 170 may include a display 105 which generates/displays an indicator indicating whether the filtering device 150 needs to be cleaned, and a sound output device 175 which outputs a sound signal indicating whether the filtering device 150 needs to be cleaned. In certain embodiments, the alarm device 170 may include only one of the display 105 and the sound output device 175. In alternative embodiments, the alarm device 170 may include both the display 105 and the sound output device 175, and only one of the display 105 and the sound output device 175 may be selected for use by a user.

The display 105 may display a text message or an icon indicating whether the filtering device 150 needs to be cleaned, or may turn a lamp on or off. For example, if the controller 160 determines that the filtering device 150 needs to be cleaned, the display 105 may display a text message "Filter Cleaning" or may turn a lamp on or off to indicate whether the filtering device 150 needs to be cleaned. The controller 160 may control the display 105 to display a blinking text message.

The display 105 may account for part of the control panel 103, which controls the functions of the dishwasher 100 and displays the operating state of the dish washer 100. For example, the display 105 may be a liquid crystal display (LCD) or a light-emitting diode (LED) disposed on one side of the control panel 103. The display 105 not only indicates whether the filtering device 150 needs to be cleaned but also displays a dishwashing program chosen by the user and the remaining operating time of the dishwasher 100. That is, referring to FIG. 2, the display 105 may include the first region 105*a* for displaying the remaining operating time of the dishwasher 100, the second region 105*b* for displaying a dishwashing program chosen by a user and the progress of the operation of the dishwasher 100, and the third region 105*c* for displaying a message indicating whether the filtering device 150 needs to be cleaned. However, embodiments as broadly described herein are not restricted to this. That is, the dishwasher 100 may also include an additional display device for displaying a message indicating whether the filtering device 150 needs to be cleaned.

The sound output device 175 may output a voice message or a sound indicating whether the filtering device 150 needs to be cleaned. For example, if the controller 160 determines that the filtering device 150 needs to be cleaned, the sound output device 175 may output a voice message saying "Please clean the filter when dishwashing is complete," or may output a sound signal such as a buzzer sound. The sound output device 175 may be a small-sized speaker (not shown) included in the dishwasher 100. By using the sound output device 175, it is possible to effectively notify the user whether the filtering device 150 needs to be cleaned even when the user is remote from the dishwasher 100.

The dishwasher 100 may also include a memory device 180 which stores information indicating whether a request for cleaning the filtering device 150 has been issued to the user through the alarm device 170, and an input device 190 which allows the user to input a command to clean the filtering device 150 upon receiving a request for cleaning the filtering device 150. A magnetic storage medium or a semiconductor memory device may be used as the memory device 180. The input device 190 may allow the user to input information indicating that the cleaning of the filtering device 150 is complete after finishing the cleaning of the filtering device 150 or may allow the user to decide whether to ignore a request for cleaning the filtering device 150.

As described above, the dishwasher 100 determines whether the filtering device 150 needs to be cleaned based on the time taken for the drain pump 141 to discharge wash fluid, and notifies the user whether the filtering device 150 needs to be cleaned using the alarm device 150. Therefore, it is possible for the user to determine whether the filtering device 150 needs to be cleaned without the need to examine the amount of food waste collected in the filtering device 150, and without an additional sensor for determining the amount of food waste collected in the filtering device 150.

In addition, it is possible to prevent the dishwasher 100 from emitting an offensive odor due to the filtering device 150 not being cleaned for a long period of time, thus preventing the performance of the dishwasher 100 from deteriorating.

Figure 5:
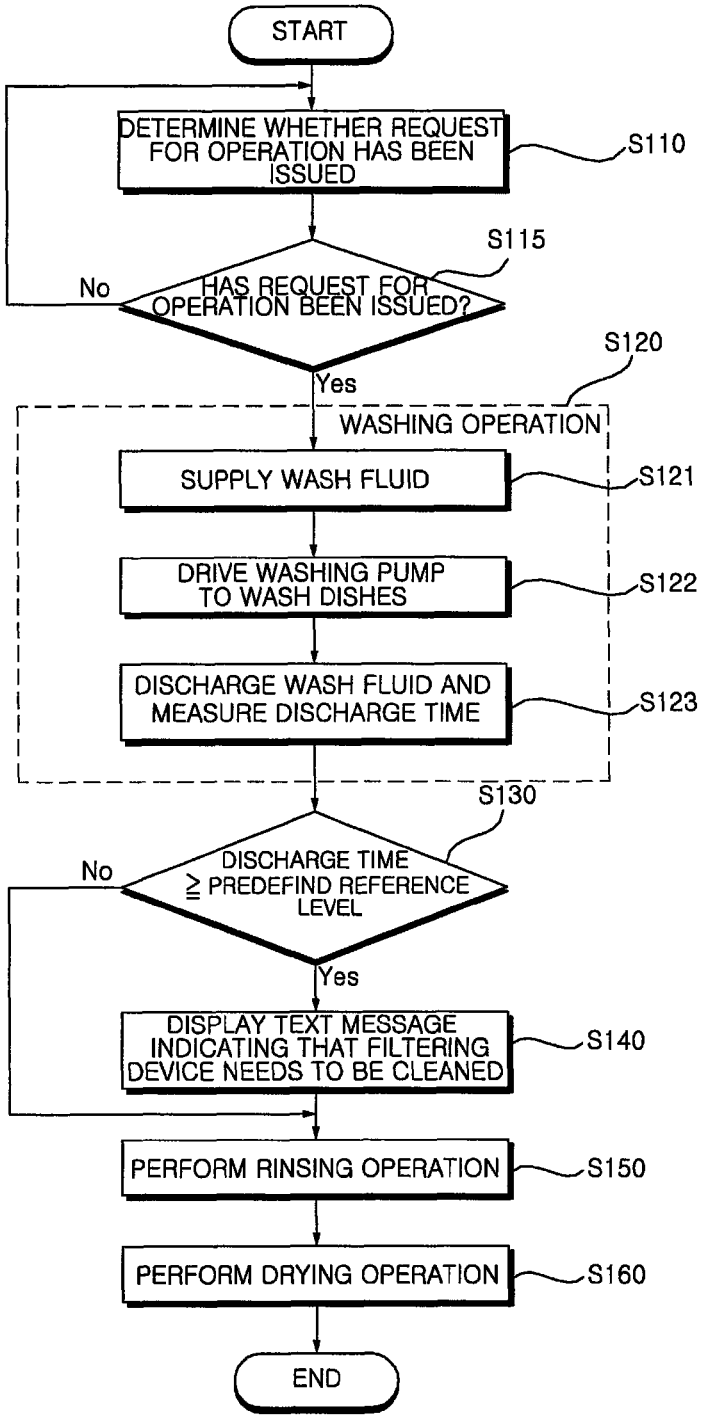
FIG. 5 illustrates a flowchart of a driving method of the dishwasher shown in FIG. 1, according to an exemplary embodiment as broadly described herein.

FIG. 5 illustrates a flowchart of an exemplary operating method for the dishwasher 100 shown in FIGS. 1-4. In the exemplary embodiment of FIG. 5, the alarm device 170 includes a display 105 that displays a text message indicating whether the filtering device 150 needs to be cleaned, and the predefined reference level is set to 1 minute. The operation of the dishwasher 100 will hereinafter be described in detail with reference to FIG. 5, mainly focusing on how to determine whether the filtering device 150 needs to be cleaned.

Referring to FIG. 5, when dishes are loaded in the tub 110, the controller 160 determines whether a request for operation of the dishwasher 100 has been issued by a user through the control panel 103 (S110).

If it is determined that a request for operation of the dishwasher 100 has been issued by the user (S115), the controller 160 performs a washing operation according to a dishwashing program chosen by the user (S120).

More specifically, the controller 160 supplies a predefined amount of wash fluid into the sump 120 through a supply valve (not shown) (S121), and drives the washing pump 121 (S122) so that the wash fluid can be sprayed into the tub 110 through the upper nozzle 124 and the lower nozzle 123. Once the washing of the dishes in the tub 110 is complete, the controller 160 discharges waste wash fluid collected in the sump 120 through the filtering device 150 by driving the drain pump 141 (S123). The controller 160 measures the time taken to completely drain the sump 120 (S123).

Once the washing of the dishes in the tub 110 is complete, the controller 160 determines whether the time taken to completely drain the sump 120 exceeds the predefined reference level, i.e., 1 minute (S130).

If the time taken to completely drain the sump 120 exceeds 1 minute, the controller 160 controls the display 105 to display a text message indicating that the filtering device 150 needs to be cleaned (S140).

Thereafter, the controller 160 performs a rinsing operation for rising the dishes in the tub 110 with clean fluid (S150) and then performs a drying operation for drying wet dishes (S160).

Figure 6:
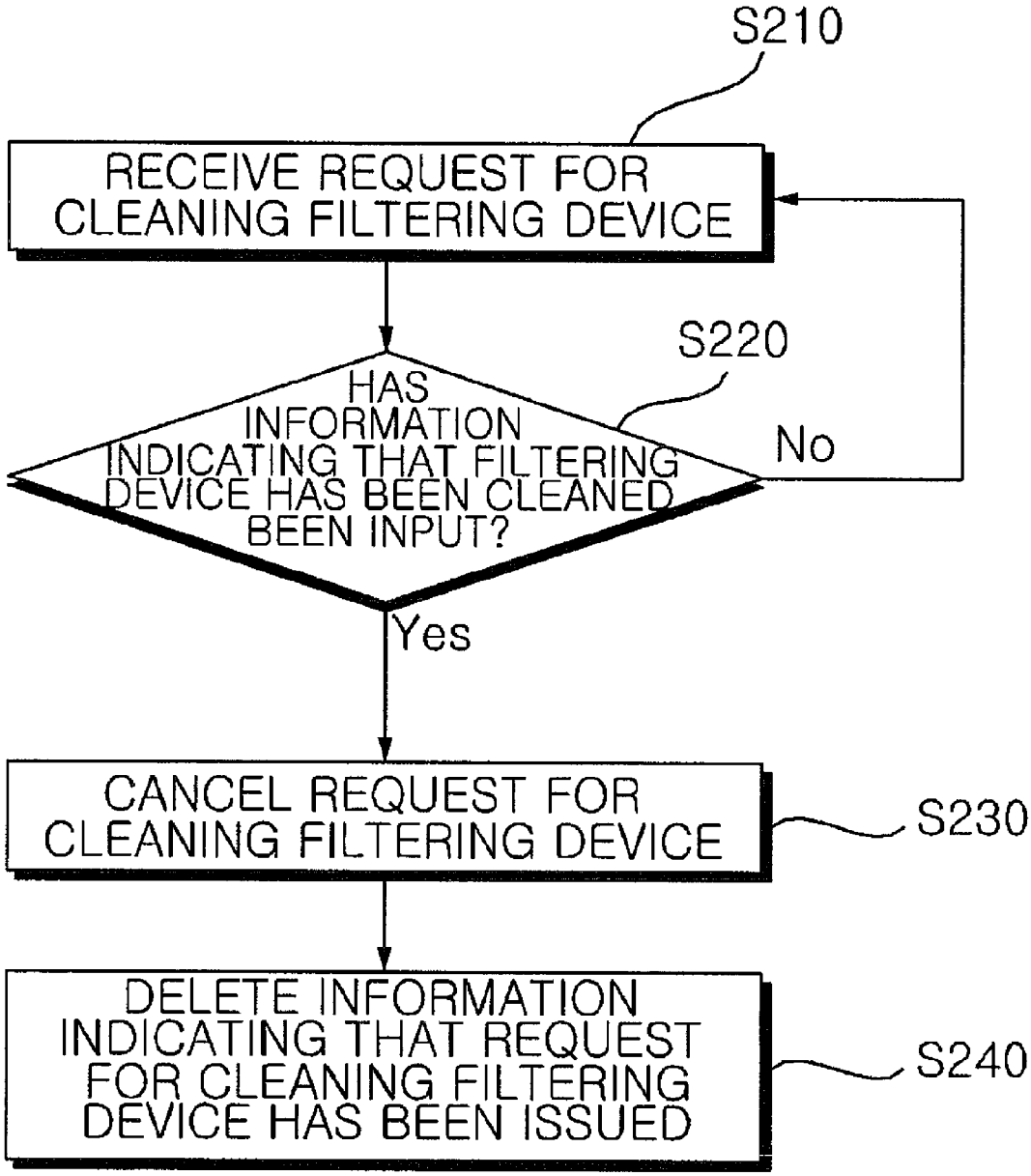
FIG. 6 illustrates a flowchart of the operation of the dishwasher shown in FIG. 1 when it is determined that a filtering device needs to be cleaned.

FIG. 6 illustrates a flowchart of the operation of the dishwasher 100 when the alarm device 170 indicates that the filtering device 150 needs to be cleaned. Referring to FIG. 6, if the controller 160 issues a request for cleaning the filtering device 150 to a user through the alarm device 170 (S210), the user cleans the filtering device 150 and then decides whether to input information indicating that the cleaning of the filtering device 150 is complete through the input device 190 (S220). If the user inputs information indicating that the cleaning of the filtering device 150 is complete through the input device 190, the controller 160 cancels the request issued in operation S210 (S230), and deletes information indicating that a request for cleaning the filtering device 150 has been issued to the user from the memory device 180 (S240). For example, the user may press a button or turn off a lamp in order to indicate that the cleaning of the filtering device 150 is complete. Then, the user may terminate the output of a beep sound indicating that the filtering device 150 needs to be cleaned and may then delete the information indicating that a request for cleaning the filtering device 150 has been issued to the user from the memory device 180.

The user may input a command to ignore the request issued in operation S210 through the input device 190. In this case, the controller 160 may cancel the request issued in operation S210 and may perform a rinsing operation. However, the controller 160 may not delete the information indicating that a request for cleaning the filtering device 150 has been issued to the user from the memory device 180 so that a request for cleaning the filtering device 150 can be issued later again to the user.

After cleaning the filtering device 150, the user may not necessarily have to input information indicating that the cleaning of the filtering device 150 is complete. Instead, the dishwasher 100 may determine whether the filtering device 150 is clean using a sensor such as a differential manometer for measuring the fluid pressure of wash fluid injected into the filtering device 150. If too much food waste accumulates in the filtering device 150, wash fluid may not be able to smoothly pass through the filtering device 150, and thus, the pressure of wash fluid injected into the filtering device 150 may increase. A differential manometer may measure the fluid pressure of wash fluid injected into the filter device 150, may compare the result of the measurement with a reference level indicating the fluid pressure of wash fluid measured from the filtering device 150 when no food waste exists in the filtering device 150, and may determine whether the filtering device 150 has been cleaned based on the results of the comparison.

If the user inputs no signal to the input device 190 within a predefined amount of time after receiving the request issued in operation S210, the controller 160 may determine that the user wishes to ignore the request issued in operation S210 and may thus proceed to a rinsing operation.

Figure 7:
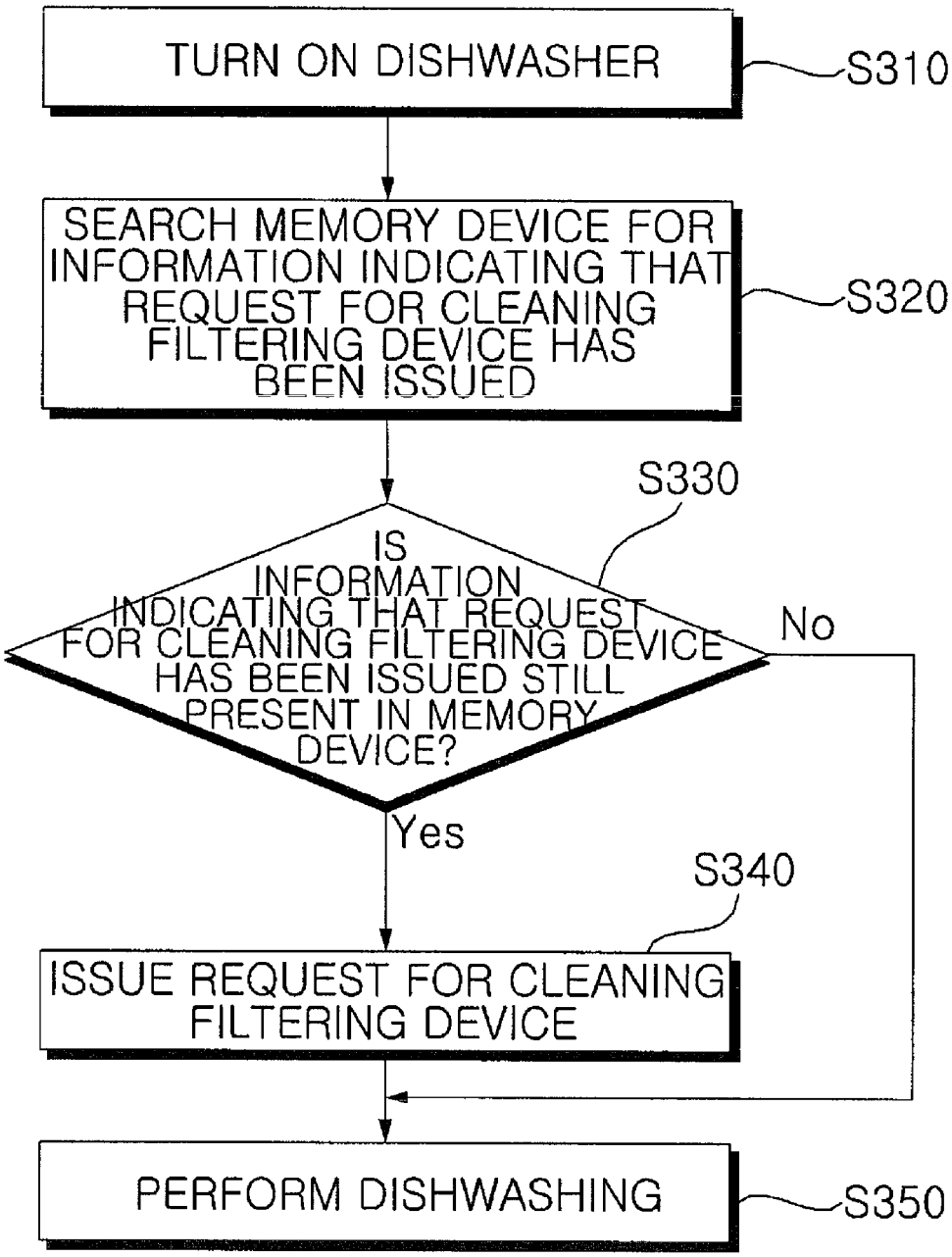

FIG. 7 illustrates a flowchart of the operation of the controller 160 when the dishwasher 100 is turned on. Referring to FIG. 7, when a user turns on the dishwasher 100 (S310), the controller 160 determines whether information indicating that a request for cleaning the filtering device 150 has been issued is stored in the memory device 180 (S320). If it is determined that the information indicating that a request for cleaning the filtering device 150 has been issued is stored in the memory device 180 (S330), the controller 160 notifies the user that the filtering device 150 needs to be cleaned through the alarm device 170 (S340).

For example, when the user turns on the dishwasher 100, the controller 160 searches the memory device 180 for the information indicating that a request for cleaning the filtering device 150 has been issued is stored in the memory device 180. If the information indicating that a request for cleaning the filtering device 150 has been issued is stored in the memory unit 180, the controller 160 may turn on a lamp of the alarm device 150 for indicating that the filtering device 170 needs to be cleaned and/or may repeatedly output a beep sound.

The user may decide whether to clean the filtering device 150 upon receiving a request for cleaning the filtering device 150 from the alarm device 170, may clean the filtering device 150 and may input information indicating that the filtering device 150 has been cleaned through the input device 190. Thereafter, the user performs a dishwashing operation using the dishwasher 100 (S350).

In the embodiment of FIG. 5, the time taken to drain the sump 120 is measured during a drain operation. However, embodiments as broadly described herein are not restricted to this. That is, the time taken to drain the sump 120 may be measured during a rinsing operation.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a sump that receives and stores wash fluid positioned below a tub;

a filtering device that filters waste out of wash fluid contained in the sump;

a drain pump that discharges the wash fluid from the sump through the filtering device;

a controller that measures a time taken for the drain pump to drain the sump and determines that the filtering device needs to be cleaned when the measured time exceeds a predefined reference level;

an alarm device that generates an indicator indicating that the filtering device needs to be cleaned; and a memory device that receives and stores information from the controller indicating that the controller has detected that the filtering device needs to be cleaned, and that receives and stores information indicating that a request for cleaning the filtering device has been issued, wherein, when the dishwasher is turned on, the controller searches the memory device for information indicating that the controller has detected that the filtering device needs to be cleaned or that a request for cleaning the filtering device has been issued, and issues a request for cleaning the filtering device through the alarm device.

2. The dishwasher of claim 1, wherein the alarm device generates a visual indicator indicating that the filtering device needs to be cleaned.

3. The dishwasher of claim 2, wherein the visual indicator comprises a lamp that is turned on or off by the controller based on whether the filtering device needs to be cleaned.

4. The dishwasher of claim 2, wherein the visual indicator comprises a text message or an icon displayed on a display to indicate that the filtering device needs to be cleaned.

5. The dishwasher of claim 4, further comprising a control panel that receives input that manipulates functions of the dishwasher, and that displays an operating state of the dishwasher, wherein the display is provided with the control panel.

6. The dishwasher of claim 1, wherein the alarm device comprises a sound output device that generates an audible indicator indicating whether the filtering device needs to be cleaned.

7. The dishwasher of claim 6, wherein the audible indicator comprises a voice message or a sound indicating whether the filtering device needs to be cleaned.

8. The dishwasher of claim 1, wherein the predefined reference level is set based on an amount of time taken to drain the sump when there is no waste present in the filtering device.

9. The dishwasher of claim 1, further comprising an input device that receives input indicating that the filtering device has been cleaned.

10. The dishwasher of claim 9, wherein the alarm device cancels the request for cleaning of the filtering device, and the controller deletes, from the memory device, information indicating that a request for cleaning the filtering device has been issued, when the input device receives an indication that the filter has been cleaned.

11. The dishwasher of claim 1, wherein the filtering device is provided in the sump.

12. A dishwasher, comprising:

a tub;

a sump positioned below the tub to receive and store wash fluid;

a filtering device that filters particles from wash fluid in the sump;

a drain device that drains the filtered wash fluid from the sump;

a controller that determines a contamination level of the filtering device based on an operating time of the drain device during a draining operation, wherein the controller measures an elapsed time during the drain operation and compares the measured elapsed time to a predetermined time to establish a contamination level of the filtering device;

an alarm device that generates an indicator indicating that the filtering device needs to be cleaned in response to a determination by the controller that the filtering device needs to be cleaned; and a memory device that receives and stores information from the controller indicating that the controller has detected that the filtering device needs to be cleaned, and that receives and stores information indicating that a request for cleaning the filtering device has been issued, wherein, when the dishwasher is turned on, the controller searches the memory device for information indicating that the controller has detected that the filtering device needs to be cleaned or that a request for cleaning the filtering device has been issued, and issues a request for cleaning the filtering device through the alarm device.

13. The dishwasher of 12, wherein the predetermined time is an amount of time required to drain the sump when the filtering device is free of contaminants.

14. The dishwasher of 13, wherein the controller issues a warning indicator requesting cleaning of the filtering device when the measured elapsed time exceeds the predetermined time.

15. The dishwasher of 14, wherein the controller cancels the warning indicator when the controller receives an input signal indicating that the filtering device has been cleaned.

16. The dishwasher of 15, wherein the controller cancels a warning indicator when a new elapsed time measured during a subsequent operation is less than the predetermined time.

17. The dishwasher of 15, wherein the warning indicator is a visual indicator, an audible indicator, or a combination thereof.

* * * * *